United States Patent [19]

Okamoto et al.

[11] Patent Number: 4,619,080

[45] Date of Patent: Oct. 28, 1986

[54] ROLL GRINDING APPARATUS FOR ROLLING MILLS

[75] Inventors: Yoshiyuki Okamoto; Kazuhiko Sato, both of Himeji; Shunji Uryu, Kitakyushu; Kiyoshi Morita, Himeji, all of Japan

[73] Assignee: Nippon Steel Corporation, Tokyo, Japan

[21] Appl. No.: 708,847

[22] Filed: Mar. 5, 1985

[30] Foreign Application Priority Data

Mar. 5, 1984 [JP] Japan ..... 59-40443

[51] Int. Cl.[4] ..... B24B 19/00

[52] U.S. Cl. ..... 51/251; 51/161; 51/255

[58] Field of Search ..... 51/251, 252, 165.71, 51/255, 161

[56] References Cited

U.S. PATENT DOCUMENTS

| | | | |
|---|---|---|---|
| 2,461,459 | 2/1949 | Wilkes | 51/252 |
| 3,165,865 | 1/1965 | Bousquet et al. | 51/251 |
| 4,516,212 | 5/1985 | Nagashima | 51/165.71 X |

FOREIGN PATENT DOCUMENTS

| | | |
|---|---|---|
| 49-45037 | 12/1974 | Japan . |
| 53-58951 | 5/1978 | Japan . |
| 54-3989 | 1/1979 | Japan . |
| 55-65061 | 5/1980 | Japan . |
| 56-14010 | 2/1981 | Japan . |
| 56-53806 | 5/1981 | Japan . |

OTHER PUBLICATIONS

Japanese Patent Application Laid-Open No. 145356/1979, Titled: Roll Grinding Device in Rolling Mill Stand.

*Primary Examiner*—Frederick R. Schmidt
*Assistant Examiner*—Maurina Rachuba
*Attorney, Agent, or Firm*—Wenderoth, Lind & Ponack

[57] ABSTRACT

A roll grinding apparatus which includes a housing adjoining a roll to be ground, guides attached to the housing which extend perpendicularly to the axis of the roll, a frame attached to the housing which is reciprocated along the guides, a piston and linkage for reciprocating the frame, inclined guides extending along the roll axis and inclined toward one end of the frame, a casing having a plurality of guide holes facing the roll and traversably mounted on the inclined guides, a cylinder and piston for reciprocating the casing laterally, a grindstone holder reciprocatively fitted in each of the guide holes, a rectangular grindstone held at the tip of the grindstone holder, and a double acting cylinder reciprocating each grindstone holder. In grinding a roll, the grindstone holder is moved out of the casing to press the grindstone against the roll surface. At the same time, the cylinder and piston for reciprocating the casing is actuated to reciprocate the casing along the inclined guides. The grindstone grinds the roll surface while spirally moving back and forth. The amount of grinding is controlled by adjusting the force with which the grindstone is pressed against the roll and the time during which grinding is continued. When no grinding is needed at a particular location on the roll surface, an individual grindstone holder at that location is withdrawn, thereby detaching the grindstone from the roll surface.

10 Claims, 12 Drawing Figures

ROLL GRINDING APPARATUS FOR ROLLING MILLS

BACKGROUND OF THE INVENTION

1. Field of the Invention

This invention relates to a roll grinding apparatus for rolling mills, and more particularly to a roll grinding apparatus that dresses the profile of used work and back-up rolls of plate mills and pinch rolls of coilers by grinding in-line.

2. Description of the Prior Art

With a view to increasing the efficiency of rolling operation, several methods of grinding work and other rolls in line while the rolling operation is in progress have been proposed as in the Japanese Utility Model Gazette No. 45037 of 1974, Japanese Provisional Patent Publications Nos. 58951 of 1978, 3989 of 1979, 65061 of 1980 and 53806 of 1981.

Previously the inventor proposed a method of grinding rolling mill rolls which comprises reciprocating a grindstone pressed against the surface of a roll not only in the direction parallel to the axis of the roll but also in the direction in which the roll rotates (Japanese Provisional Patent Publication No. 14010 of 1981). By this method, the roll surface can be ground efficiently and precisely without causing grindstone blocking and abrasion. In this method, the roll surface is ground with a plurality of rectangular grindstones reciprocatively disposed along the roll axis. While being kept in close contact with the roll surface, the grindstones are driven in such a manner as to make a motion in which said two reciprocative movements are combined.

To grind the roll surface to a desired shape with precision machining on the order of μm according to the method just described, it is necessary to press the individual grindstones against the roll surface with an appropriate amount of pressure and put the grindstones in exact working position with respect to the roll to be dressed. For increasing the operational efficiency, it is also necessary to rapidly place the grindstones in the desired position. So far, however, no combined grinding apparatus satisfying such requirements has been proposed.

SUMMARY OF THE INVENTION

This invention has been made to solve the abovementioned problems with the conventional roll grinding apparatus. The object of this invention is to provide a roll grinding apparatus for rolling mills which permits precise grinding of rolls and rapid setting of a group of grindstones in working position.

A roll grinding apparatus according to this invention comprises a housing adjoining a roll to be ground, guides attached to the housing in such a manner as to extend perpendicularly to the axis of the roll, a frame attached to the housing in such a manner as to be reciprocated along the guides, means reciprocating the frame, inclined guides provided to the frame in such a manner as to extend along the roll axis and incline toward one end of the frame, a casing having a plurality of guide holes opening to the roll side disposed along the roll axis and traversably mounted on the inclined guides, means reciprocating the casing laterally, a grindstone holder reciprocatively fitted in each of the guide holes, a rectangular grindstone held at the tip of the grindstone holder, and grindstone reciprocating means provided for each grindstone holder.

The housing may be either shared in common by a rolling stand or provided separately. The frame reciprocating means and casing traversing means should preferably be a hydraulic cylinder or motor. A pneumatic cylinder or an electric motor may also serve the purpose. The guide hole and the sliding portion of grindstone holder are precision-finished so that the grindstone holder smoothly slides through the guide hole while being held in close contact therewith. The grindstone holder reciprocating means is a pneumatic or hydraulic double-acting cylinder. With this means placed inside the sliding portion of the grindstone holder, the holder has a high enough rigidity to withstand considerable vibration and chattering, with a resulting increase in reliability. Being mechanically interlocked with a grindstone clamp, stopper and extending means, the grindstone holder needs only one drive means and, therefore, can be readily installed even on an existing mill where available space might be limited.

Guide rails, rollers, sliding plates and other similar means may be used as the inclined guides which allow the casing to be moved diagonally back and forth to and from one end thereof.

The apparatus thus constructed is provided for each of the top and bottom rolls.

When there arises a need to mount or dismount a roll on or from a rolling stand for roll changing or other reasons, the frame is withdrawn by actuating the frame reciprocating means. Then, the grindstone is moved away from the roll along with the casing, back into a place where the grindstone does not interfere with the mounting and dismounting of the roll. When the roll has been mounted on the rolling stands, the frame reciprocating means is actuated to advance the frame until the grindstone is brought close to the roll surface.

In grinding a roll, the grindstone holder reciprocating means is actuated to move the grindstone holder out of the casing, whereupon the grindstone is pressed against the roll surface and the frame is reciprocated by means of the casing traversing means. Then, the grindstone dresses the roll surface in a spiral pattern while moving back and forth therealong. The amount of dressing is controlled by adjusting both the force with which the grindstone is pressed against the roll surface and the grinding time.

With no grinding is done, the grindstone holder is withdrawn away from the roll surface by means of the grindstone holder reciprocating means

BRIEF DESCRIPTION OF THE DRAWINGS

FIGS. 5, 6 and 7 are a sectional plan view, a sectional side elevation and a front view showing a grindstone 57 moved of the grindstone holder without touching a roll to be ground, respectively. FIGS. 8 and 9 are a sectional plan view and a sectional side elevation showing the grindstone kept in contact with the roll, respectively;

DESCRIPTION OF THE PREFERRED EMBODIMENT

Now a preferred embodiment of this invention will be described by reference to accompanying drawings.

Figure 1:
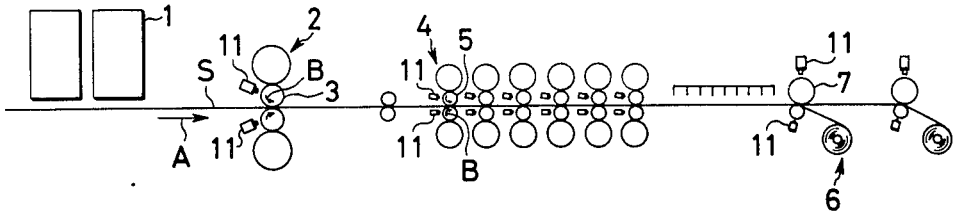
FIG. 1 is a schematic illustration of a rolling mill line on which a roll grinding apparatus according to this invention is installed.

FIG. 1 shows an example in which a roll grinding apparatus of this invention is applied to a hot-strip mill comprising a reheating furnace 1, a roughing stand 2, a finishing mill train 4 and a coiler 6. The roll grinding apparatus of this invention is best fitted for grinding such rolls as the work rolls 3 of the roughing stand 2 and the work rolls 5 of the finishing stand 4 of a hot-strip mill that wear off heavily during use. It is also applicable to such rolls as the pinch rolls 7 of the coiler 6 and the rolls of a tandem and reversing mill that are employed in a cold-strip mill, not shown, whose wear presents various problems. In addition to the simple four-high mill shown in the described example, the finishing mill 4 may also be of the six-high, cross-country or other types.

The arrow A shows the direction in which the strip S travels and the arrow B indicates the direction in which the rolls rotate.

Figure 2:
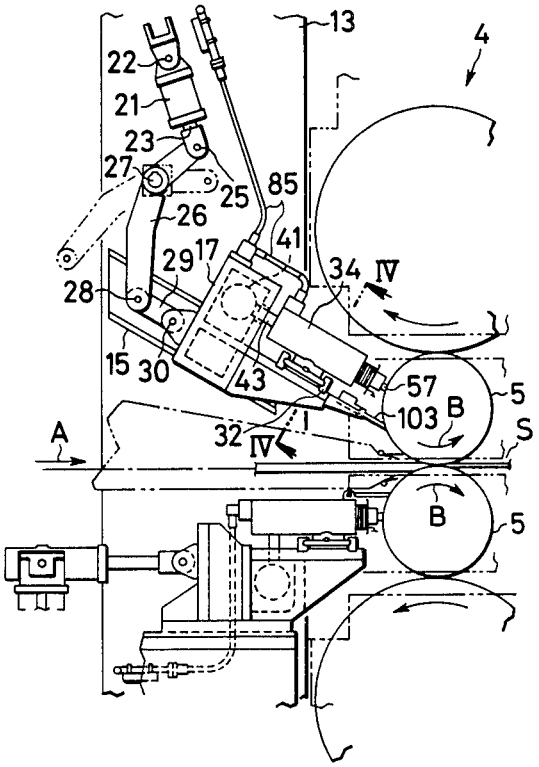
FIG. 2 is an overall side elevation of a roll grinding apparatus of this invention.
Figure 3:
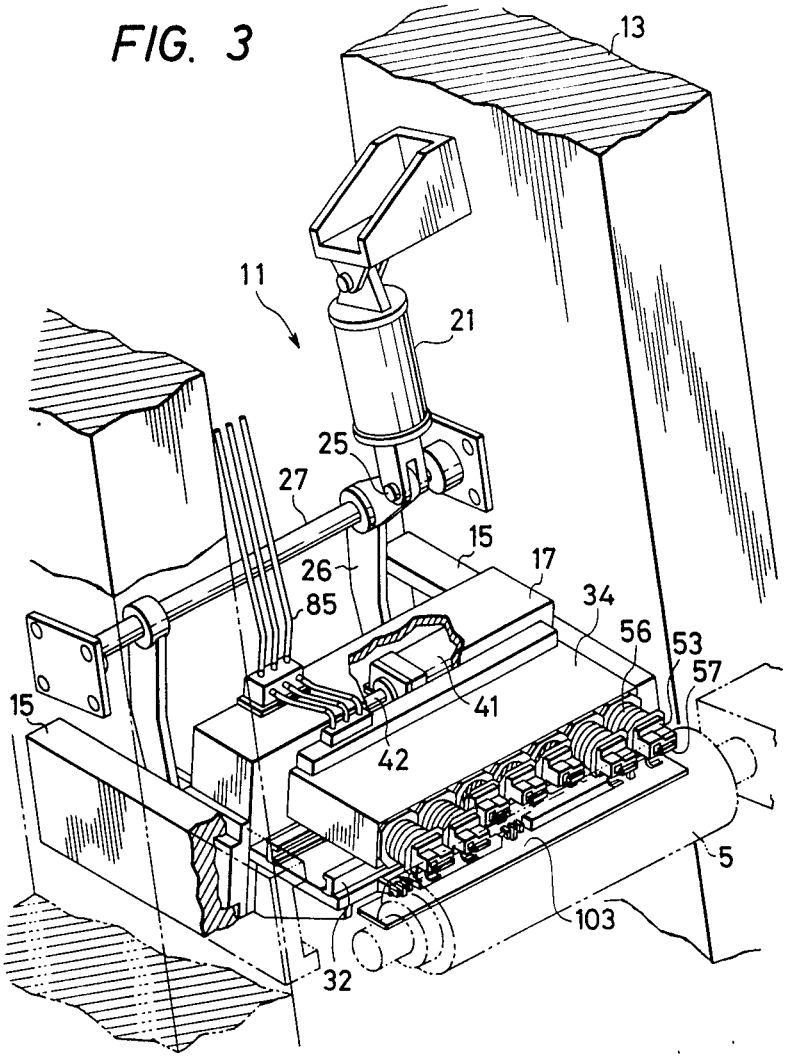
FIG. 3 is a perspective view of a top roll grinding apparatus.

FIG. 2 is a side elevation showing the entirety of a roll grinding apparatus 11 and FIG. 3 is a perspective view of a top roll grinding apparatus 11. A bottom roll grinding apparatus is analogous to the top roll grinding apparatus in structure and function, the only difference being the positions in which they are installed. As such, similar parts are designated by similar reference characters, with the description thereof omitted. As illustrated, a pair of guides 15 inclined forward or toward a roll 5 are provided in a housing 13. The guides 15 extend perpendicularly from the axis of the roll 5.

The housing 13 also carries a reciprocative frame 17 through said guides 15.

A swingable hydraulic cylinder 21 is also attached to the housing 13 through a pin 22. One end of a crank 26 is connected to the rod 23 of the hydraulic cylinder 21 through a pin 25, with the middle part of the crank 26 fastended to a shaft 27 rotatably fitted to the housing 13. To the other end of the crank 26 is connected a link bar 29 through a pin 28, with the other end of the link bar connected to the rear end of said frame 17 by means of a pin 30. Thus, the cylinder rod 23, crank 26 and link bar 29 make up a linkage. The frame 17 is therefore moved back and forth by the action of the hydraulic cylinder 21.

A pair of rails 32 extending along the axis of the roll and having a plurality of slots inclined toward one side of the frame 17 are provided near the front end of the frame 17.

Figure 4:
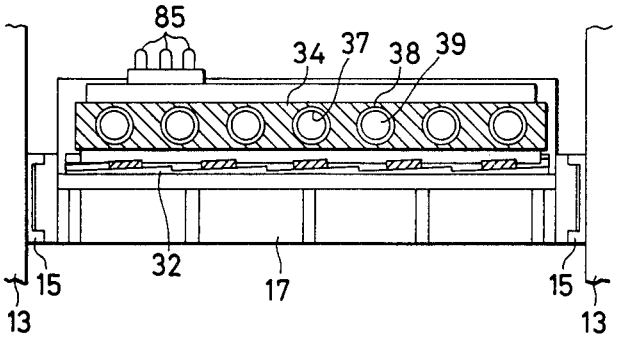
FIG. 4 is a cross-sectional view taken along the line IV—IV of FIG. 2.

A traversable block-shaped casing 34 is mounted to slide in the slots of the rail 32. The casing 34 has seven holes 37 that open forwardly as shown in FIG. 4, with a sleeve 38 fitted in each of the holes 37.

A hydraulic cylinder 41 is provided near the rear end of the frame 17, with the rod 42 thereof connected to the casing 34 through a coupling 43. By the action of the hydraulic cylinder 41, the casing 34 moves diagonally over the rails 32 to and from the sides of the frame 17.

Figure 5:
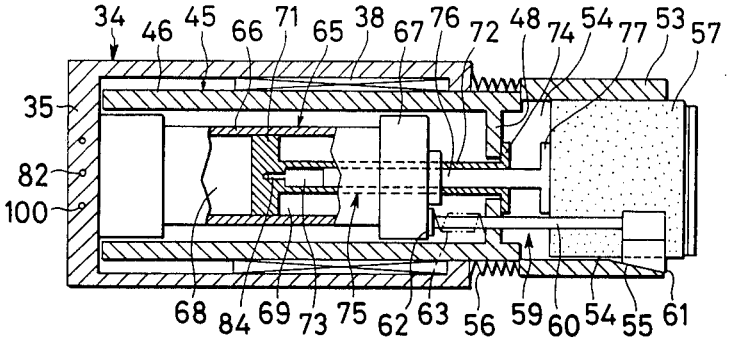
FIGS. 5 to 9 show details of a grindstone holder according to this invention.
Figure 6:
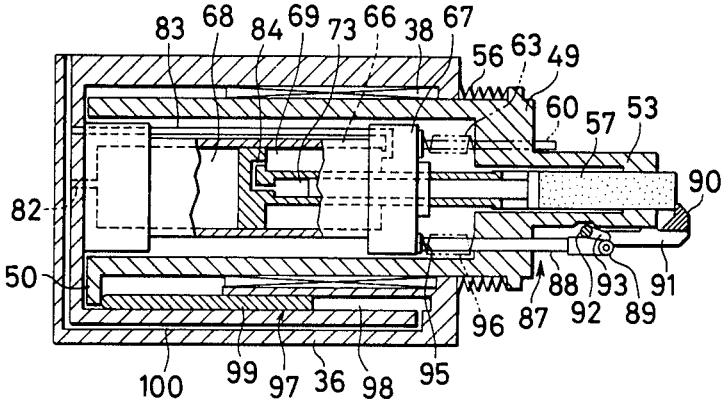
Figure 7:
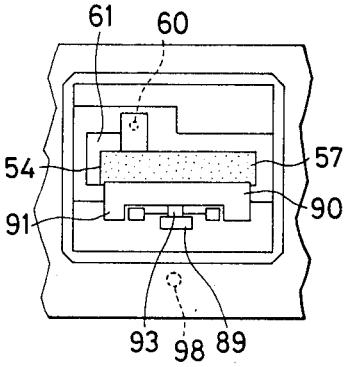
Figure 8:
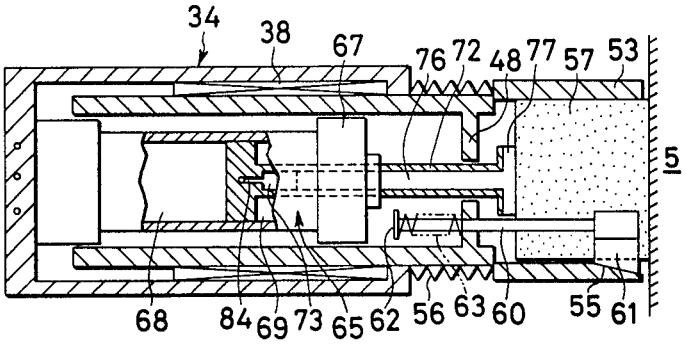
Figure 9:
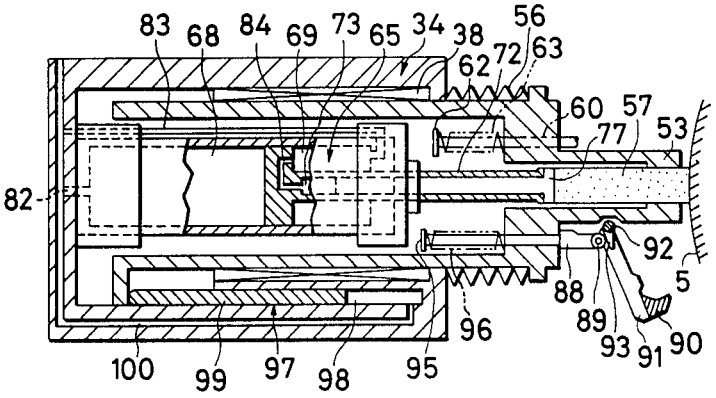

FIGS. 5 to 9 show the details of a grindstone holder 45. While FIGS. 5 to 7 show a grindstone 57 pushed out of a grindstone holding portion 53 without touching the roll 5, FIGS. 8 and 9 show the grindstone 57 kept in contact with the roll 5.

As will be seen, the grindstone holder 45 comprises a cylindrical sliding portion 46 and the grindstone holding portion 53 that is a forward continuation thereof.

The sliding portion 46 is slidably fitted in a guide hole 39 in said sleeve 38. The precision-finished internal surface of the guide hole 39 and external surface of the sliding portion 46 offer little resistance to each other, thereby permitting the grindstone holder 45 to move back and forth smoothly.

The grindstone holding portion 53 has a square hole 54 in which a plate-shaped grindstone 57 is reciprocatively fitted. The grindstone 57 is fastened to the grindstone holding portion 53 by means of a clamp mechanism 59 to be described next. A bellows 56 is provided between the sliding portion 46 and the grindstone holding portion 53 to prevent dust and vapor from entering the clearance between the sliding portion 46 and the sleeve 38.

A longitudinal taper 55 is provided near the front end of one side wall 54 of the grindstone holding portion 53. A clamp rod 60 reciprocatively passes through a bulkhead 48 between the sliding portion 46 and grindstone holding portion 53. A wedge 61 and a spring seat 62 are provided to the front and rear end of the clamp rod 60, respectively. A spring 63 is inserted between the spring seat 62 and the bulkhead 48.

When the grindstone holder 45 is moved backward by the action of a double-acting pneumatic cylinder 65, the spring seat 62 strikes the cover 67 of the double-acting pneumatic cylinder 65 and the clamp rod 60 moves forward with respect to the grindstone holder 45. As a consequence, the grindstone 57 is released from the wedge 61 to move back and forth freely. When the grindstone holder 45 moves forward, the spring seat 62 is separated from the cover 67 of the double-acting pneumatic cylinder 65 and sent backward by the force of the spring 63. Then, the wedge 61 enters the clearance between the grindstone 57 and the tapered portion 55 of the side wall 54, thereby fastening the grindstone 57 to the grindstone holder 45. Since the plate-shaped grindstone 57 is grasped from both sides, the grindstone will not be damaged by the force of the clamp even if the grindstone may have deformed slightly or any foreign matter has entered the holder.

The double-acting pneumatic cylinder 65 is positioned inside the sliding portion 46 of each grindstone holder 45, with the cylinder tube 66 fastened to the rear wall 35 of the casing 34. A tubular piston rod 72 passing through the cover 67 and bulkhead 48 forms a single-acting pneumatic cylinder 75 in conjunction with a ram 76 inserted therein.

The rear wall 35 of the casing 34 is provided with a passage 82 through which compressed air is supplied to the piston-side chamber 68 of the double-acting pneumatic cylinder 65 and to the rod-side chamber 69 thereof through a pipe 83. Compressed air is also supplied from the rod-side chamber 69 to the ram chamber 73 through a passage 84 in the piston 71. The passage 82 and the pipe 83 are independent from each other and respectively receive the supply of compressed air through a flexible tube 85 shown in FIG. 2. Each flexible tube 85 is provided with a stop valve and a pressure-regulating valve (not shown).

When compressed air is supplied to the ram chamber 73, the ram 76 moves forward to bring the flange 77 at the front end thereof in contact with the rear surface of the grindstone 57 which is, in turn, pushed out of the grindstone holding portion 53. When compressed air is supplied to the piston-side chamber 68 of the double-acting pneumatic cylinder 65, the piston rod 72 is moved forward to bring the flange 74 at the front end thereof in contact with the rear surface of the ram flange 77, then advancing further to push the entirety of the grindstone holder 45 further out of the casing 34. The whole grindstone holder 45 is moved backward when compressed air is supplied to the rod-side chamber 69.

A grindstone stopper 87 is provided on the front portion of the grindstone holder 45. A rod 88 passed through the head 49 of the sliding portion of the grindstone holder 45, while an arm 91 having a pawl 90 at the front end thereof is rotatably attached to the grindstone holding portion through a shaft 92. A cam 93 is attached to a point some distance away from the front end of the rod 88 through the shaft 92. The rear end of the rod 88 constitutes a spring seat 95, with a spring 96 interposed between the spring seat 95 and said bulkhead 48. A roller 89 to actuate the cam 93 is pivotally fitted to the front end of the rod 88.

When the grindstone holder 45 withdraws, the cylinder cover 67 pushes forward the rod 88, thereby rotating the cam 93 which, in turn, causes the arm 91 to rotate into a horizontal position, whereupon the pawl 90 turns up to prevent the grindstone 57 from moving forward. When the grindstone holder 45 moves forward, the spring seat 95 is released from the cylinder cover 67 and the rod 88 moves backward by the force of the spring 96. As a consequence, the cam 93 rotates to turn the arm 91 clockwise, thereby disengaging the pawl 90 from the front end of the grindstone 57.

The casing 34 has a plunger chamber 98 that extends forward in the bottom 36 thereof. The front end of a plunger 99 inserted in the plunger chamber 98 is in contact with the flange 50 at the rear end of the grindstone holder 45. The plunger chamber 98 and plunger 99 make up a balancing mechanism 97. With compressed air supplied from a passage 100 to the plunger chamber 98, the plunger 99 pushes backward the grindstone holder 45. Because the top roll grinding apparatus 11 inclines forward as shown in FIG. 2, the grindstone holder 45 tends to jump out of the casing 34 under its own weight but is supported by the plunger 99 so that the weight of the grindstone holder 45 is balanced with the thrust exerted by the plunger 99. Being installed in a horizontal position as shown in FIG. 2, the bottom roll grinding apparatus 11 requires no balancing mechanism 97.

A wiper 103 is attached to the front end of the frame 17. Being kept in close contact with the roll 5 between the grindstone 57 and the strip S, the wiper 103 clears the ground chips off the roll surface, thus preventing the strip surface from being damaged thereby.

Figure 10:
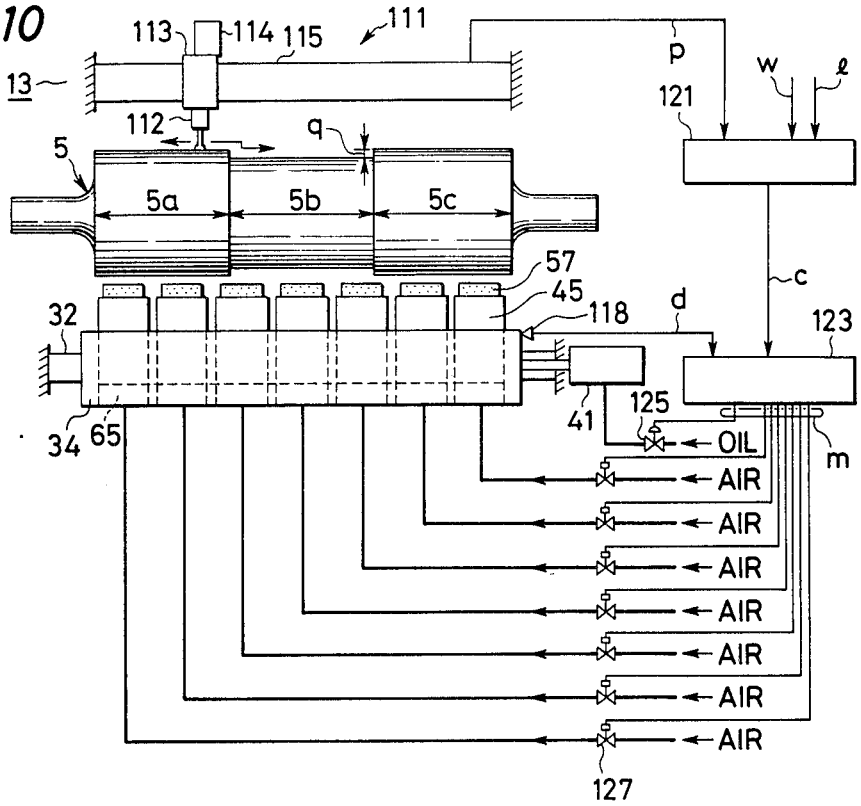
FIG. 10 is a schematic diagram showing a grinding control system.

FIG. 10 schematically shows a grinding control system which essentially comprises a sensor 111, a control computer (TOSBAC 7/70G) 121 and a controller 123. The sensor 111 has a roll profile meter 112 and a grindstone position detector 118. A guide rail 115 is provided across the housing 13 parallel to the shaft of the roll 5. A carriage 113, which is driven by a motor 114 along the guide rail 115, is mounted thereon. The carriage 113 carries the roll profile meter 112 that determines the shape of the roll surface. An air micrometer, a water micrometer or an eddy-current displacement meter, for example, may be used as the roll profile meter 112. The grindstone position detector 118 is an ordinary displacement meter that senses the position of the casing 34 accommodating the grindstone holder 45 in the direction of the roll axis.

The strip width w and the roll-body length l are present in the control computer 121, with a detection signal p inputted from the roll profile meter 112.

To the controller 123 are inputted a detection signal d from the grindstone position detector 118 and a control signal c, which instructs a grinding mode (showing whether the grindstone is grinding the roll surface or not) to each grindstone 57, from the control computer 121. The controller 123 outputs an operation signal m to the control valve 125 of the hydraulic cylinder 41 that traverses the casing 34 according to the signal c from the control computer to control the stroke and cycle of the reciprocative motion of the casing. The controller 123 also outputs an operation signal m to the control valve 127 of the pneumatic cylinder 65 that moves the grindstone holder 45 back and forth according to the signals c and d.

Now a method of grinding the roll 5 using the roll grinding apparatus 11 just described will be explained as follows.

Figure 11:
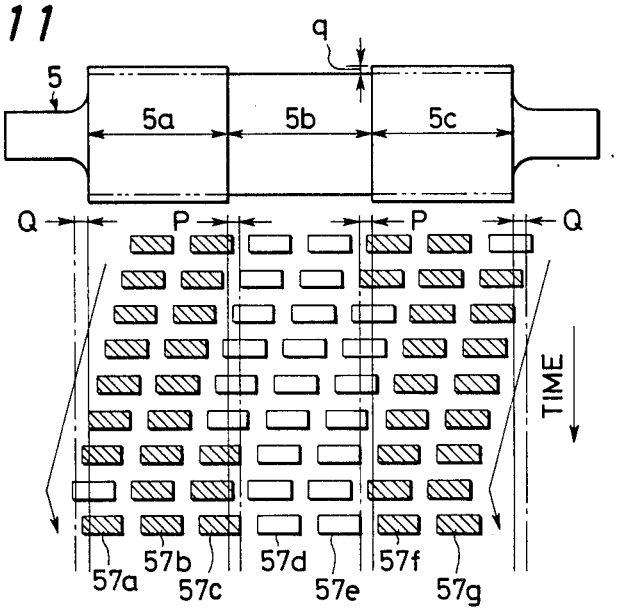
FIG. 11 illustrates a roll grinding method that is implemented by employing a roll grinding apparatus of this invention.
Figure 12:
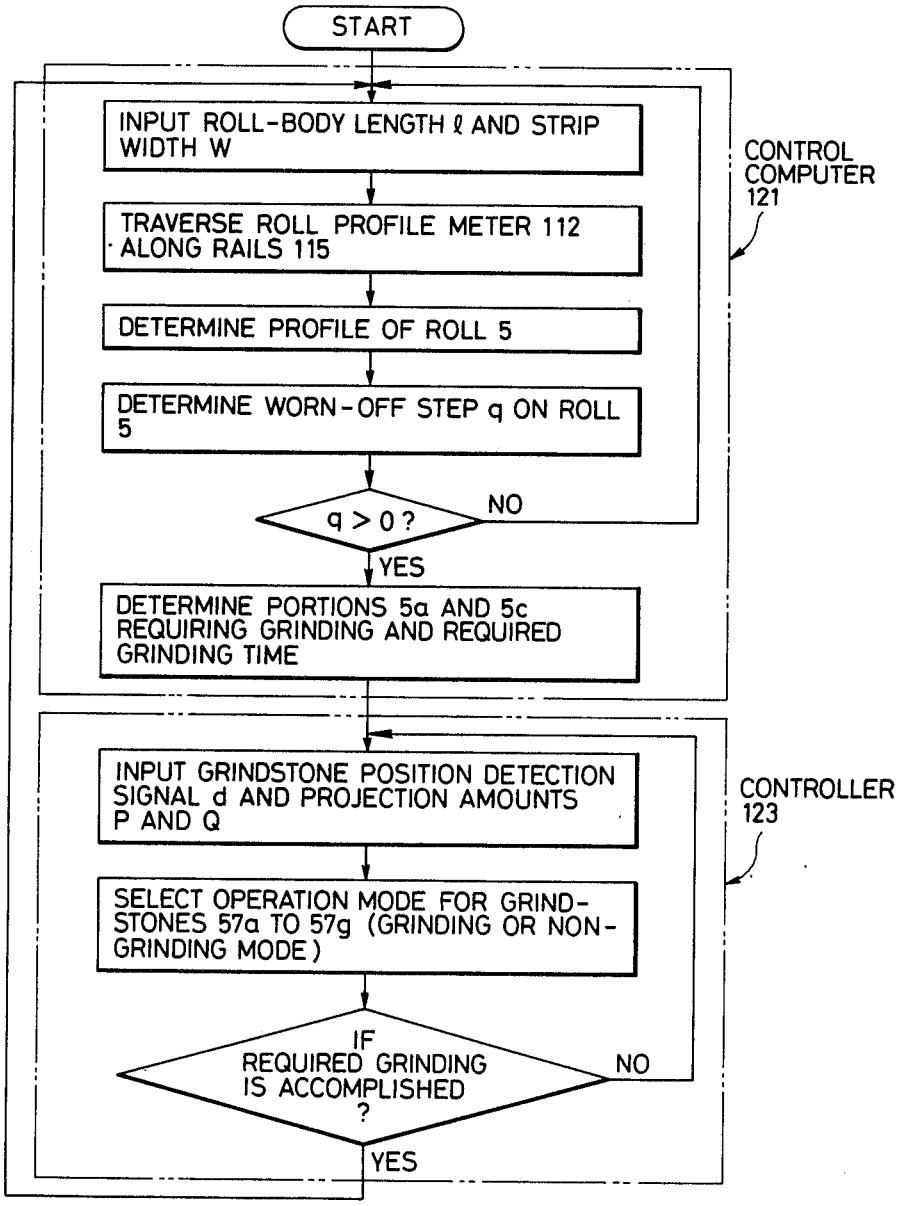
FIG. 12 is a flow chart showing the sequence of roll grinding control according to this invention.

FIG. 11 illustrates a roll grinding method, showing a worn-off roll, the loci drawn by the reciprocating grindstones over the surface of the rotating roll, and the grinding modes of the grindstones in a time-series arrangement. FIG. 12 is a flow chart showing the sequence of roll grinding control.

As a result of repeated rolling, the roll 5 usually wears off in a portion **5*b* where the strip passes, thereby creating a difference q in diameter between the portion 5*b* and the remaining portions 5*a* and 5*c* where the strip does not pass. As such, the portions 5*a* and 5*c* must be ground off. To accomplish such grinding, the profile of the roll surface is directly determined along the roll axis by use of the roll profile meter 112 at a proper time during operation. On the basis of the difference q derived from the measurement p, the strip width w and the roll-body length l, the control computer 121 determines the profile of the worn-off roll 5, pinpoints the portions 5*a* and 5*c*** requiring grinding, and the required grinding time.

To grind off only the portions **5*a* and 5*b* thus established, only necessary grindstones 57 are chosen and pressed against the surface of the rotating roll. These operations are carried out as follows in accordance with the instruction m that is outputted from the controller 123 on the basis of the control signal c from the control computer 121**.

To grind off the unused portions **5*a* and 5*c* of the roll 5, the limits P and Q within which the projection of the grindstone 57 beyond the stepped portion and the roll edge should be kept are determined. When the projection of a grindstone 57 moving with the traversing of the casing 34 exceeds the preset limit P or Q, the individual grindstones 57 are controlled so that the over-projecting grindstones 57 are withdrawn away from the roll surface. In FIG. 11, the grindstones 57*a* and 57*g* are withdrawn when the projection beyond the roll edge exceeds the limit Q while the grindstones 57*c* and 57*e*** are withdrawn when the projection beyond the stepped portion exceeds the limit P, shifting from the grinding mode to the non-grinding mode. Pressed forward against the roll surface, the grindstones 57*b* and 57*f* are at all times in the grinding mode, whereas the grindstone 57*d* is always withdrawn and in the non-grinding mode. The advance and withdrawal of the grindstones 57 are timed according to the signal c from the control computer 121 and the signal d from the grindstone position detector 118. In the figure, the hatched rectangle show a grindstone in the grinding mode and the blank rectangle indicates a grindstone in the non-grinding mode.

Thus, the roll surface is always kept smooth by determining the profile of the roll 5 as desired and grinding off only the unused portions 5*a* and 5*c*. When the roll surface has become roughened, the whole surface may be ground uniformly. If any biased wear is detected on the roll 5 by the roll profile meter 112, corrective grinding can be applied as well.

In grinding the roll 5 as described above, the frame 17 is moved forward to the grinding position by means of the hydraulic cylinder 21. At this point, the grindstone holder 45 is still held inside the casing 34 as shown in FIGS. 5 and 6.

When there arises a need to correct the profile of the roll 5 during rolling, compressed air is supplied to the double-acting pneumatic cylinder 65 of a grindstone holder 45 corresponding to the portion requiring grinding in the direction of the roll axis, whereby the grindstone holder 45 pushed out of the casing 34. As shown in FIGS. 8 and 9, the grindstone 57 is fastened inside the grindstone holding portion 53 by the clamp mechanism 59 and the pawl 90 is disengaged from the front end of the grindstone 57. The grindstone 57 and grindstone holder 45 are integrally pushed by the double-acting penumatic cylinder 65 until the roll surface is reached. With the compressed air controlled appropriately, the grindstone 57 is kept in contact with the roll surface with the desired pressure.

Simultaneously with the above operation, the hydraulic cylinder 41 is actuated to move the casing 34 back and forth diagonally. The grindstone 57 is pressed against the roll surface and moves back and forth therealong with the diagonal reciprocation of the casing 34. That is, the grindstone 57 moves back and forth spirally over the roll surface.

The profile of the roll 5 may be either measured directly with the roll profile meter or estimated from the shape of the rolled strip S. The roll profile can also be estimated from the calculation based on such rolling conditions as the load applied in rolling, overall length of strip, properties of steel, properties and temperature of the roll. Grinding is accomplished by pressing against the roll only such grindstones 57 as are required by the desired profile thereof.

When worn off as a result of grinding, the grindstone 57 is pushed out of the grindstone holding portion 53 of the grindstone holder 57 as follows. First, the double-acting pneumatic cylinder 65 is actuated to draw the grindstone holder 45 into the casing 34. Then, the cover 67 of the double-acting pneumatic cylinder 65 pushes the rod 60 of the clamp mechanism 59 and the rod 88 of the stopper mechanism 87. As a consequence, the arm 91 of the stopper mechanism 87 turns to bring the pawl 90 immediately in front of the end surface of the grindstone holding portion 53, thereby disengaging the grindstone 57. The space between the end surface of the grindstone holding portion 53 and the pawl 90 is set equal to the desired amount of pay-out. At the same time, compressed air is supplied to the ram chamber 73 of the single-acting cylinder 75 to cause the ram 77 to push the grindstone 57 out of the grindstone holding portion 53. On striking against the pawl 90, the grindstone 57 has been paid out over the desired distance.

The roll grinding apparatus 11 of this invention comprises the traversable casing 34 mounted on the reciprocative frame 17, the casing 34 carrying a plurality of slidable grindstone holders 45. The grindstone 57 is fastened to each grindstone holder 45. This arrangement permits rapidly setting all grindstones in the grinding position. Being slidably fitted in the casing 34, the grindstone holder 45 can move smoothly, which, in turn, assures the smooth motion of the grindstone 57. This means that the grindstone 57 is at all times pressed against the roll surface with a constant pressure, thus assuring precision grinding.

This invention is by no means limited to the preferred embodiment described above. For instant, the casing may be traversed by an electric motor. The traversing roll profile meter may also be replaced with a plurality of roll profile measuring heads disposed along the roll axis.

What is claimed is:

1. A roll grinding apparatus for use on a rolling mill which comprises:

a housing adapted to be positioned adjacent a roll having a roll axis;

a frame guide disposed on said housing and having at least one guide surface which extends in a direction which is perpendicular to said roll axis;

a frame movably mounted along said at least one guide surface of said frame guide;

means for moving said frame towards and away from said roll axis;

a casing guide disposed on said frame and extending in a direction perpendicular to said at least one guide surface of said frame guide;

a casing movably mounted on said casing guide, said casing having a plurality of guide holes facing said roll axis;

means for moving said casing reciprocatively along said casing guide;

a plurality of grindstone holders, each of said grindstone holders slidably disposed in a respective guide hole;

a plurality of grindstones, each of said grindstones disposed on a respective grindstone holder, said grindstones facing said roll axis; and means for independently reciprocating each of said grindstone holders towards and away from said roll axis, said grindstone holder reciprocation means including hydraulic cylinder means attached to each of said grindstone holders for selectively moving an individaul grindstone towards and away from a roll to be ground.

2. The roll grinding apparatus of claim 1, wherein said casing guide includes slots which are inclined with respect to said perpendicular direction of said casing guide, said casing being guided for reciprocal movement by said slots.

3. The roll grinding apparatus of claim 1, further comprising a plurality of means for clamping each respective one of said grindstones, each of said plurality of grindstone clamping means comprising a wedge disposed between a respective grindstone and a respective grindstone holder and a rod movably supported by said respective grindstone holder, said rod connected to said wedge for causing said wedge to grip or release said respective grindstone.

4. The roll grinding apparatus of claim 1, further comprising a plurality of grindstone stoppers, each of said grindstone stoppers mounted on a respective grindstone holder, each of said grindstone stoppers comprising a rod movably supported at one end thereof by a respective grindstone holder, a cam mechanism attached to a free end of said rod and an arm having a pawl which is engageable with a respective grindstone, said arm being connected to said cam mechanism for pivoting said pawl into and out of engagement with said respective grindstone.

5. The roll grinding apparatus of claim 1, wherein said hydraulic cylinder means comprises a plurality of double-acting fluid-pressure actuated cylinders, each of said double-acting fluid-pressure actuated cylinders operable to move a respective grindstone holder towards and away from said casing, each of said double-acting fluid-pressure actuated cylinders including a cylinder tube fastened to said casing, a tubular piston rod having one end thereof slidably received in said cylinder tube and another end thereof operable to move a respective grindstone holder away from said casing and a ram having one end thereof slidably received in said tubular piston rod and another end thereof engageable with a respective grindstone to push said respective grindstone away from said casing.

6. The roll grinding apparatus of claim 1, wherein each of said grindstones has a rectangular parallelpiped shape and each of said grindstones is disposed breadthwise in a respective grindstone holder.

7. The roll grinding apparatus of claim 1, wherein said casing includes a plurality of plunger chambers and a plurality of plungers, each of said plungers being disposed in a respective plunger chamber, each of said plungers being engageable with a respective grindstone holder for moving said respective grindstone holder further into a respective guide hole in said casing.

8. The roll grinding apparatus of claim 1, further comprising means for sensing a profile of a roll surface, means sensing a position of said casing in a direction of said roll axis, computer means for selecting one or more of said grindstones to grind the roll surface by comparing signals from said means sensing the profile of the roll surface with signals from said means sensing the position of said casing and control means for actuating said grindstone holder reciprocation means in response to signals from said computer means.

9. A roll grinding apparatus for use on a rolling mill which comprises:

a housing adapted to be positioned adjacent a roll having a roll axis;

a frame guide disposed on said housing and having at least one guide surface which extends in a direction which is perpendicular to said roll axis;

a frame movably mounted along said at least one guide surface of said frame guide;

means for moving said frame towards and away from said roll axis;

a casing guide disposed on said frame and extending in a direction perpendicular to said at least one guide surface of said frame guide;

a casing movably mounted on said casing guide, said casing having a plurality of guide holes facing said roll axis;

means for moving said casing reciprocatively along said casing guide;

a plurality of grindstone holders, each of said grindstone holders slidably disposed in a respective guide hole;

a plurality of grindstones, each of said grindstones disposed on a respective grindstone holder, said grindstones facing said roll axis; and means for independently reciprocating each of said grindstone holders towards and away from said roll axis, said grindstone holder reciprocation means including hydraulic cylinder means attached to each of said grindstone holders for selectively moving an individual grindstone towards and away from a roll to be ground, said hydraulic cylinder means comprising a plurality of double-acting fluid-pressure actuated cylinders, each of said double-acting fluid-pressure actuated cylinders operable to move a respective grindstone holder towards and away from said casing, each of said double-acting fluid-pressure actuated cylinders including a cylinder tube fastened to said casing, a tubular piston rod having one end thereof slidably received in said cylinder tube and another end thereof operable to move a respective grindstone holder away from said casing and a ram having one end thereof slidably received in said tubular piston rod and another end thereof engageable with a respective grindstone to push said respective grindstone away from said casing.

10. A roll grinding apparatus for use on a rolling mill which comprises:

a housing adapted to be positioned adjacent a roll having a roll axis;

a frame guide disposed on said housing and having at least one guide surface which extends in a direction which is perpendicular to said roll axis;

a frame movably mounted along said at least one guide surface of said frame guide;

means for moving said frame towards and away from said roll axis;

a casing guide disposed on said frame and extending in a direction perpendicular to said at least one guide surface of said frame guide;

a casing movably mounted on said casing guide, said casing having a plurality of guide holes facing said roll axis;

means for moving said casing reciprocatively along said casing guide;

a plurality of grindstone holders, each of said grindstone holders slidably disposed in a respective guide hole;

a plurality of grindstones, each of said grindstones disposed on a respective grindstone holder, said grindstones facing said roll axis, said grindstone holders including grindstone stoppers mounted thereon, each of said grindstone stoppers comprising a rod movably supported at one end thereof by a respective grindstone holder, a cam mechanism attached to a free end of said rod and an arm having a pawl which is engageable with a respective grindstone, said arm being connected to said cam mechanism for pvioting said pawl into and out of engagement with said resepctive grindstone; and means for independently reciprocating each of said grindstone holders towards and away from said roll axis, said grindstone holder reciprocation means including hydraulic cylinder means attached to each to said grindstone holders for selectively moving an individual grindstone towards and away from a roll to be ground.

* * * * *